United States Patent [19]

Schlecht

[11] Patent Number: 4,653,990

[45] Date of Patent: Mar. 31, 1987

[54] POSITIVE DOUBLE-PISTON DISPLACEMENT PUMP CONVEYING PASTEOUS MATERIAL

[76] Inventor: Karl Schlecht, Blumhardstrasse 9, 7000 Stuttgart 70, Fed. Rep. of Germany

[21] Appl. No.: 735,314

[22] Filed: May 20, 1985

[30] Foreign Application Priority Data

May 26, 1984 [DE] Fed. Rep. of Germany ..... 3419832

[51] Int. Cl.[4] ..... F04B 15/02; F04B 21/06

[52] U.S. Cl. ..... 417/517; 417/519; 417/532; 417/900; 137/625.45

[58] Field of Search ..... 417/516, 519, 531, 532, 417/900; 137/625.44, 625.45, 874, 875

[56] References Cited

U.S. PATENT DOCUMENTS

| | | | |
|---|---|---|---|
| B 351,055 | 1/1975 | Bille | 417/516 |
| 3,663,129 | 5/1972 | Antosh | 417/516 |
| 3,832,097 | 8/1974 | Schlecht | 417/516 |
| 4,142,846 | 3/1979 | Yoshikawa | 419/900 X |
| 4,373,875 | 2/1983 | Schwing | 417/900 X |
| 4,382,752 | 5/1983 | Schlecht | 417/516 |

FOREIGN PATENT DOCUMENTS 62766 10/1982 European Pat. Off. ..... 417/900

*Primary Examiner*—Carlton R. Croyle
*Assistant Examiner*—Theodore W. Olds
*Attorney, Agent, or Firm*—Erwin S. Teltscher; Peter R. Ruzek

[57] ABSTRACT

In positive displacement pumps using double pistons for the alternating supply of pasteous material from two supply cylinders through a pivotable feed tube arranged in a feed chamber spaced at a radial distance from a controllably positionable shaft, the supply end of the feed tube is subjected to wear, which can impair the seal of the pump, and result in bleeding off of the pasteous material. In the inventive pump the supply conduit is connected to the pivotable feed tube through a pivotably arranged connecting member, through which adjustment of a sealing ring disposed in a rear wall of the feed chamber, and abutting a ring-shaped and also easily replaceable wear-resistant ring-shaped member is facilitated, while also permitting easy replacement of the sealing ring.

10 Claims, 4 Drawing Figures

POSITIVE DOUBLE-PISTON DISPLACEMENT PUMP CONVEYING PASTEOUS MATERIAL

BACKGROUND OF THE INVENTION

1. Field of the Invention

The invention relates to a positive dual position displacement pump alternately conveying pasteous material through a reciprocally pivotable feed tube to a supply conduit.

2. Description of the Prior Art

Displacement pumps of this type have become known, for example, from German laid-open specifications Nos. 1,453,705, and 2,933,128, as well as from British Patent Specification No. 1,098,338. None of the afore described references however, meet the requirement for a long service life, due to the occurrance of excessive wear and tear. Furthermore, the displacement pumps of the prior art do not permit the parts exposed to wear to be easily replaced, so that in the event of any wear, and consequent deterioration of the required seal, the reciprocally pivotable feed tube of the pump needs to be readjusted or replaced. It is a further disadvantage of the displacement pumps of the prior art that a not inconsiderable torque is generally required for reciprocally driving the pivotable feed tube, with a concomitant increase of energy consumption of the pump.

SUMMARY OF THE INVENTION

It is therefore an object of the present invention to avoid the afore cited disadvantages of the prior art. This is achieved by providing an easily replaceable ring-shaped member or plate made of wear-resistant material, releasably secured to the pivotable feed tube, and abutting a connecting member which establishes communication between a supply conduit for the pasteous material and a feed tube therefor. Sealing means are interposed between the feed tube and the connecting member, are easily replaced from the exterior, and are operatively adjustable with respect to the ring-shaped member. This arrangement provides the additional advantage that the connecting member, which abuts a rear wall of the feed chamber, is so arranged and positioned at the outlet of the reciprocally pivotable feed tube, and which is subjected to wear, may be readily replaced, as already stated, but that furthermore a seal interposed between that ring-shaped member or cover plate may easily be readjusted and/or easily replaced in the event of any wear of the seal itself.

The novel features which are considered as characteristic of the invention as set forth in particular in the appended claims. The invention itself, however, together with additional objects and advantages thereof, will best be understood from the following description of the specific embodiments read in conjunction with the accompanying drawings.

BRIEF DESCRIPTION OF THE DRAWING

The invention will be more readily understood with the aid of the drawing, in which.

Figure 1:
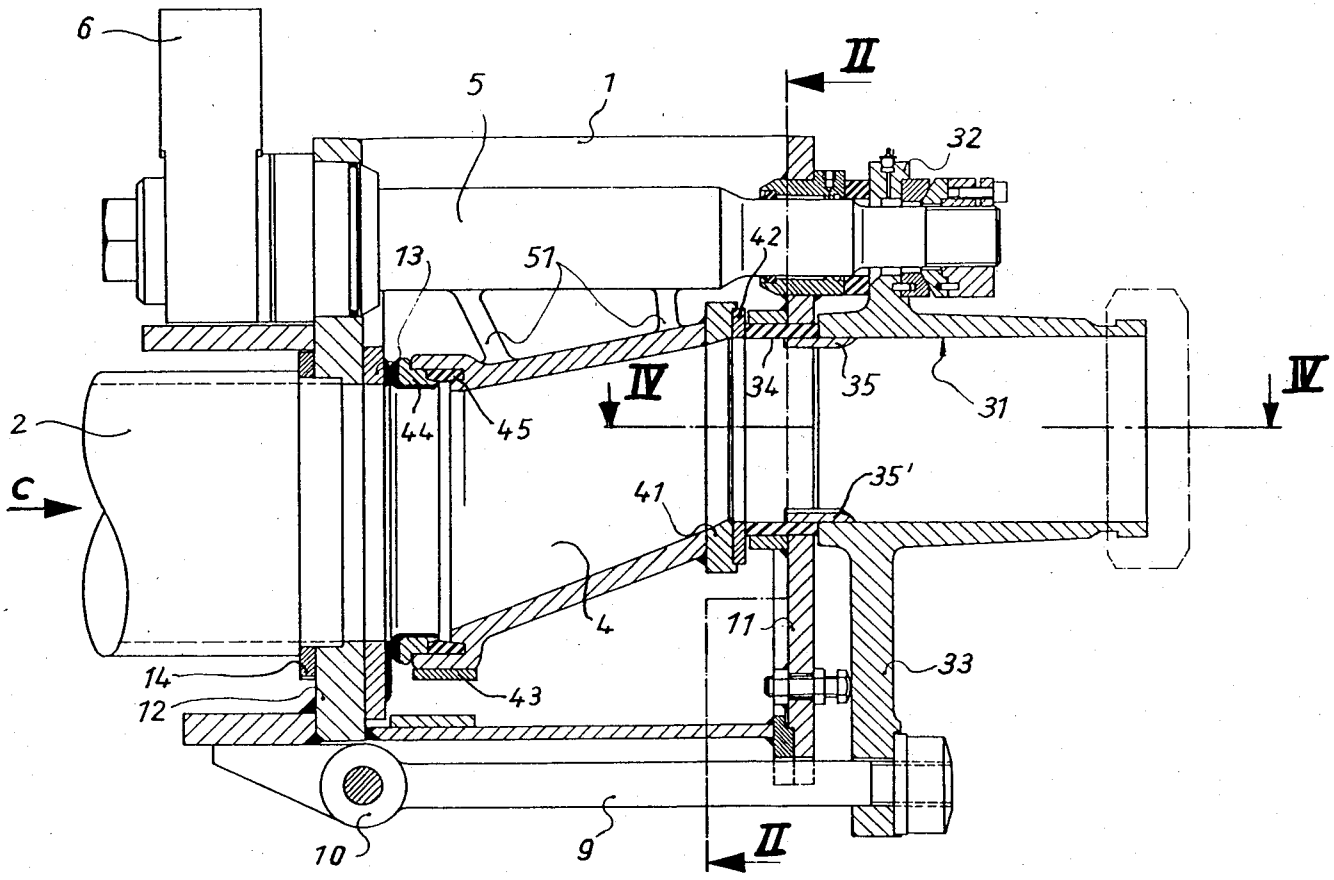
FIG. 1 is a longitudinal section through the displacement pump according to the invention, along the line I—I shown in FIG. 2.
Figure 2:
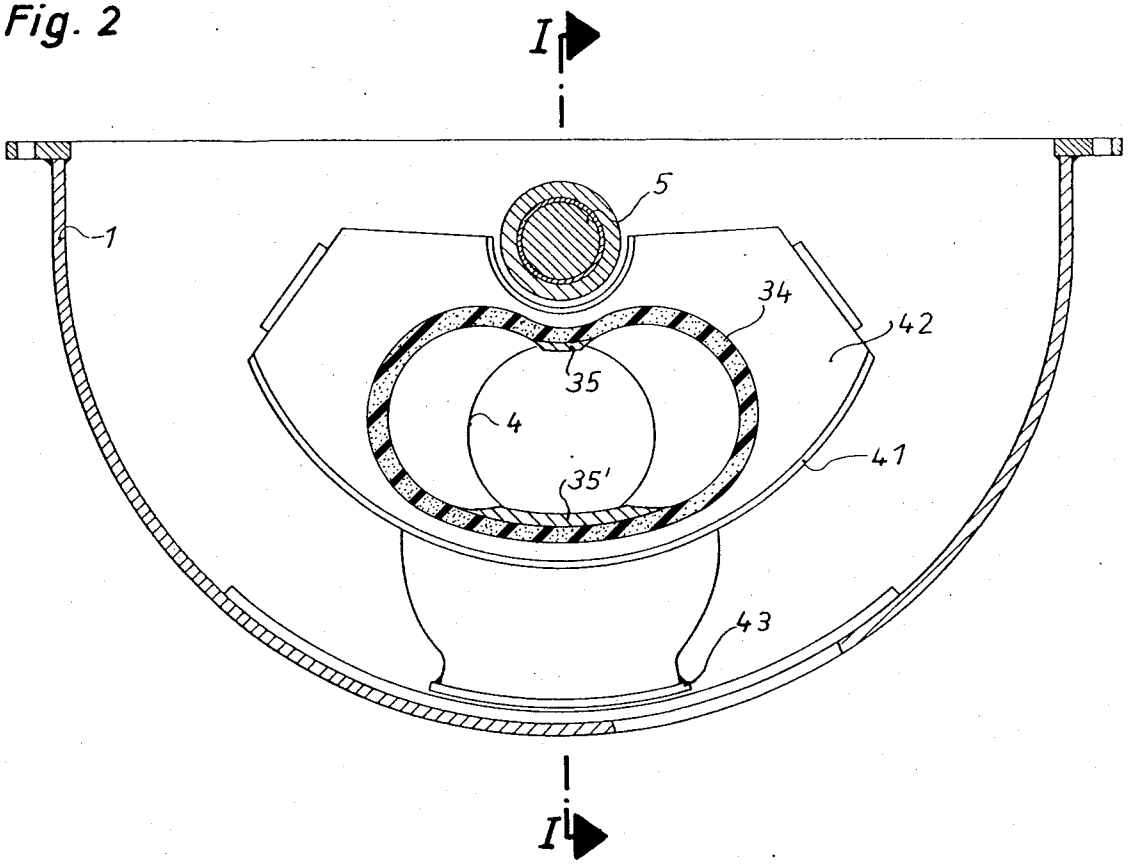
FIG. 2 is a section of the displacement pump along the line II—II of FIG. 1.
Figure 3:
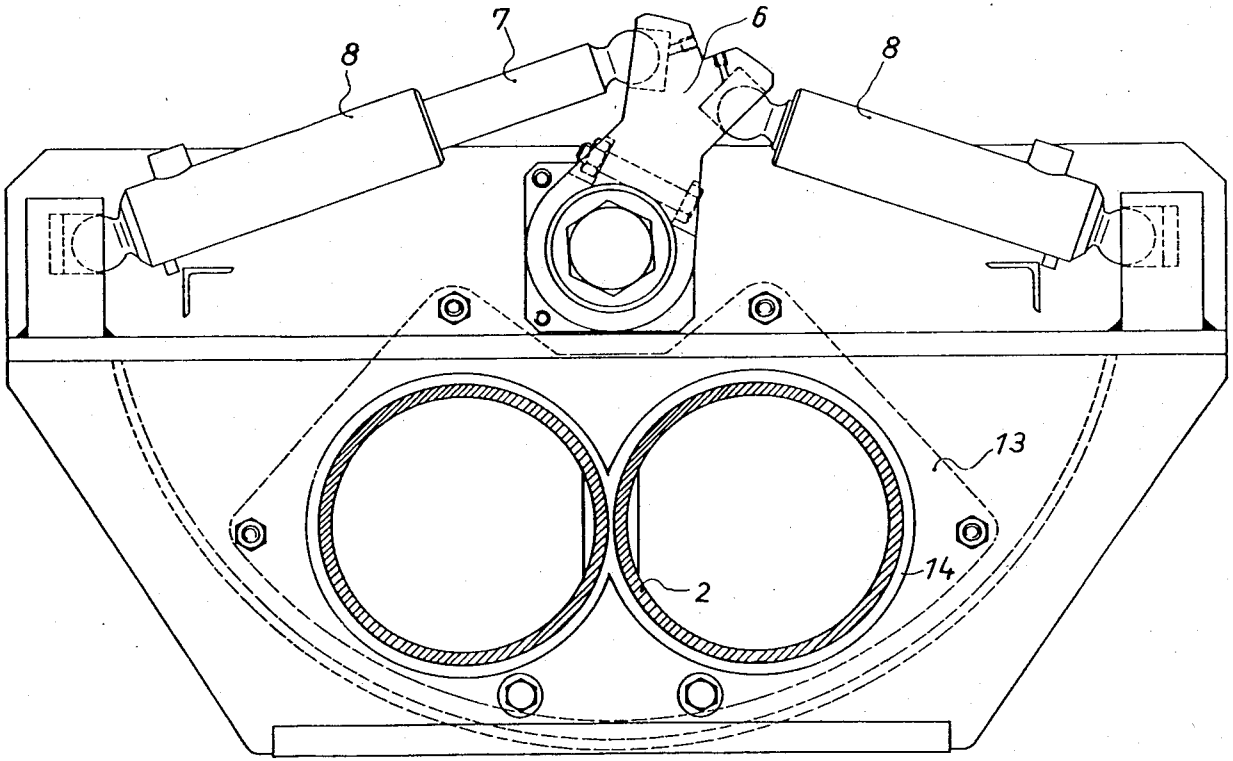
FIG. 3 is a front elevation view of the displacement pump as viewed along the arrow C shown in FIG. 1.
Figure 4:
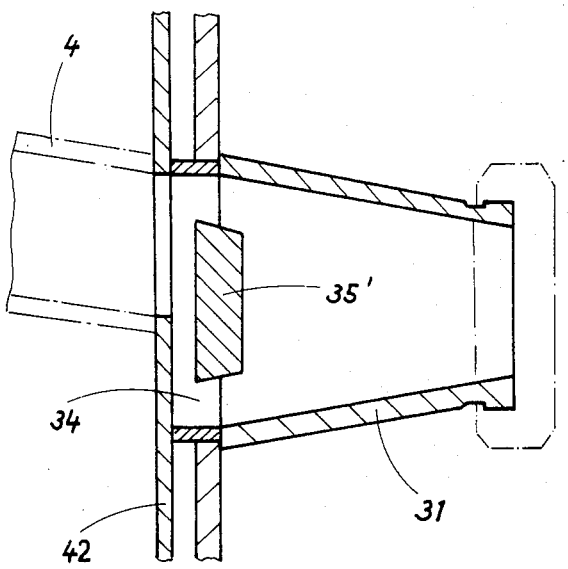
FIG. 4 is a plan view of a detail of the displacement pump, showing in particular the position of the feed tube of the displacement pump when connected to a rearwardly positioned supply cylinder.

DESCRIPTION OF THE PREFERRED EMBODIMENTS.

Referring now to the drawings, two supply cylinders 2 flanged onto a wall 12 of a feed chamber 1 are secured thereto by means of a plate 14. A wear plate 13 is disposed on a wall 12 of the feed chamber 1; a ring 44 abuts the wear plate 13, and is shiftable along an axial direction with respect to a reciprocally pivotable feed tube 4, but is also sealed thereagainst by means of a sealing ring 45. Near the inlet of the pivotable feed tube 4 there is disposed a strip-off bar 43 in a lower region thereof, while a front plate 41 is welded to an opposite end of the feed tube 4. A ring-sector shaped member or plate 42 is, in turn, replaceably arranged in the front plate 41. Near a rear wall 11 of the feed chamber 1 there is disposed a connecting member 31; a supply conduit 3 is connected to the connecting member 31, while a sealing ring 34, which is disposed in a recess of the rear wall 11, is interposed between the feed tube 4 and the connecting member 31. Connecting elements 35 and 35' hold the connecting member 31 and the sealing ring 34 to one another. The connecting member 31, in turn, is provided with an upper extension element 32, and a lower extension element 33. A longitudinal anchor 9 in tension is pivotably connected to a bearing 10, the bearing 10 being secured to either the wall 12 or to the feed chamber 1 itself.

The pivotable feed tube 4 is connected by means of two rods 51 to a controllably positionable shaft 5, which, in turn, is supported in the walls 11 and 12 of the feed chamber 1, and is reciprocally driven through a switching lever 6 by drive means, for example two cylinder-piston mechanisms 7,8. A stump of the controllably positionable shaft 5 extends outwardly beyond the rear wall 11 of the feed chamber 1, and is received in an opening of the upper extension element 32 of the connecting member 31; in this manner the connecting member 31 is pivotable about that stump. By implementing the displacement pump in this manner, and in particular the connecting member 31, any forces exerting pressure onto the sealing member 34 can be transferred, on one hand through the shaft 5, and on the other hand through the tension anchor 9 onto the wall 12, which, in turn, is connected to the feed chamber 1. As a result of this construction, and the consequent transfer of any pressures, the feed chamber 1 can be of a relatively lightweight construction.

While the invention has been illustrated in a preferred embodiment, it is not to be limited to the structures shown, since many variations thereof will be evident to one skilled in the art, and are intended to be encompassed in the present invention as set forth in the following claims.

What is claimed is:

1. A positive displacement pump adapted to convey pasteous material, comprising in combination a feed chamber, a reciprocally pivotable feed tube of a circular cross-section arranged in said feed chamber, drive means operable to drive said feed tube, two supply cylinders adapted to receive said pasteous material, a connecting member secured to a rear wall of said feed chamber, said feed tube having a diminishing cross-sectional area along a direction leading to said connecting member, said connecting member having a cross-section of about twice the area of the circular cross-section of said feed tube near said rear wall, a supply conduit communicating with said connecting member, said supply cylinders being adapted to supply said pasteous material to said supply conduit, and being arranged to alternately communicate with said supply conduit through said reciprocally pivotable feed tube, said connecting member establishing communication between said supply conduit and said feed tube, sealing means interposed between said feed tube and said connecting member, and easily replaceable from the exterior, and an easily replaceable ring-sector-shaped plate member made of a wear-resistant material releasably secured to said feed tube, and abutting said sealing means, said sealing means being operatively adjustable with respect to said ring-sector-shaped plate member and being pressed against said ring-sector-shaped plate member by said connecting member.

2. A positive displacement pump adapted to convey pasteous material, comprising in combination a feed chamber, a reciprocally pivotable feed tube of a circularly shaped cross-sectional area arranged in said feed chamber between front and rear walls of said feed chamber as seen in a direction of flow of the pasteous material through said feed tube, drive means operable to drive said feed tube, two supply cylinders adapted to receive said pasteous material, a connecting member secured to said rear wall of said feed chamber, and having a decreasing cross-sectional area as seen in said direction of flow of said pasteous material, said cross-sectional area of said connecting member near said rear wall being about twice the cross-sectional area of said feed tube near said rear wall, a supply conduit communicating with said connecting member, said connecting member establishing communication between said supply conduit and said feed tube, said supply cylinders being adapted to supply said pasteous material to said supply conduit, and being arranged to alternately communicate with said supply conduit through said reciprocally pivotable feed tube, sealing means interposed between said feed tube and said connecting member, and easily replaceable from the exterior, and an easily replaceable ring-sector-shaped plate member made of a wear-resistant material releasably secured to said feed tube, and abutting said sealing means, said sealing means being operatively adjustable with respect to said ring-sector-shaped plate member and being pressed against said ring-sector-shaped plate member by said connecting member.

3. The positive displacement pump as claimed in claim 2, wherein said drive means include a controllably positionable shaft spaced from said feed tube, said connecting member serving as a pressure receiving member, and on said upper extension element including an upper extension element and a lower extension element, and further comprising a bearing supporting a stump of said controllably positioned shaft, and an anchor in tension pivotably connected to a front wall of said feed chamber near said supply cylinders and movably connected to a free end of said lower extension element.

4. The positive displacement pump as claimed in claim 3, wherein said bearing supporting said stump of said controllably positionable shaft is a pressure bearing receiving a free end of said upper extension element.

5. The positive displacement pump as claimed in claim 3, wherein said feed tube has an inlet and an outlet spaced from said controllably positioned shaft by a distance smaller than a corresponding distance separating said controllably positionable shaft from said inlet.

6. The positive displacement pump as claimed in claim 3, wherein said drive means include two piston-cylinder mechanisms operably connected in opposition to one another.

7. The displacement pump as claimed in claim 1, wherein said feed tube has a diminishing cross-sectional area along a direction leading to said supply conduit.

8. The positive displacement pump as claimed in claim 7, wherein said feed tube is a truncated cone defining a center axis subtending an acute angle with a center axis of said supply conduit.

9. The positive displacement pump as claimed in claim 2, wherein said sealing means is a sealing ring, and the crosssection of said sealing ring is kidney-shaped.

10. The positive displacement pump as claimed in claim 3, wherein said anchor is longitudinal.

* * * * *